US008839478B2

(12) United States Patent
Grammatis et al.

(10) Patent No.: US 8,839,478 B2
(45) Date of Patent: Sep. 23, 2014

(54) RAILROAD TRACK CLEANING ASSEMBLIES AND APPARATUS

(75) Inventors: Dan A. Grammatis, Franklin Park, IL (US); John Kim, Darien, IL (US)

(73) Assignee: Swingmaster Corporation, Franklin Park, IL (US)

( * ) Notice: Subject to any disclaimer, the term of this patent is extended or adjusted under 35 U.S.C. 154(b) by 328 days.

(21) Appl. No.: 13/224,686

(22) Filed: Sep. 2, 2011

(65) Prior Publication Data

US 2012/0222580 A1 Sep. 6, 2012

Related U.S. Application Data

(60) Provisional application No. 61/379,483, filed on Sep. 2, 2010.

(51) Int. Cl.
*E01B 31/17* (2006.01)

(52) U.S. Cl.
USPC ..... 15/55; 104/279

(58) Field of Classification Search
CPC ..... E01B 27/00; E01B 27/06; E01B 27/10; E01B 27/102; E01B 31/17; E01H 8/02; E01H 8/10; B61F 19/00
USPC ..... 15/49.1, 54–55, 78, 87, 79.2; 104/279
See application file for complete search history.

(56) References Cited

U.S. PATENT DOCUMENTS 646,087 A * 3/1900 Branch ..... 15/55
4,235,029 A 11/1980 Ulm
5,054,401 A * 10/1991 Lindholm ..... 104/279
5,493,795 A 2/1996 Bail
7,992,245 B2 * 8/2011 Schuetz et al. ..... 15/52.1

FOREIGN PATENT DOCUMENTS

GB 2284186 A * 5/1995

OTHER PUBLICATIONS

Voith Turbo GmbH & Co., "Track cleaning train of MVG with L2r4 zseU2 turbo reversing transmission, SK-456 and KE-456 final drives and cardan shafts," Aug. 2008, pp. 1-2.
Zweiweg Schneider GmbH & Co., "Cleaning Units for Grooved Rails," http://www.zweiweg.de/com/pdf/030030050030020e.pdf [Retrieved from the Internet on Aug. 1, 2012], pp. 1-2.
Modern Track Machinery, Inc., "Geismar Catalog," http://www.haratrading.fi/Geismar.pdf, [Retrieved from the Internet on Aug. 1, 2012], pp. 1-103, pp. 24 relating to "Grinders & Shears."
Photos of Apparatus to Clean Railroad Tracks Using Pressurized Liquid, Dec. 19, 2009, pp. 1-11.

* cited by examiner

*Primary Examiner* — Laura C Guidotti
(74) *Attorney, Agent, or Firm* — Hanley, Flight & Zimmerman, LLC

(57) ABSTRACT

Railroad track cleaning assemblies and apparatus are described. An example railroad track cleaning assembly includes a movable carriage movably coupled to a frame to which a plurality of wheels are operably coupled to enable the frame to move on railroad tracks. Additionally, the railroad track assembly includes a shaft rotatably coupled to the movably carriage to receive one or more brushes that are to be rotated and engage one of the railroad tracks and a spring assembly coupled to the movable carriage and to the frame to bias, via the movable carriage, the one or more brushes into engagement with the one of the railroad tracks.

18 Claims, 11 Drawing Sheets

RAILROAD TRACK CLEANING ASSEMBLIES AND APPARATUS

RELATED APPLICATION

This application claims the benefit of U.S. Provisional Application No. 61/379,483, filed Sep. 2, 2010, which is incorporated herein by reference in its entirety.

FIELD OF THE DISCLOSURE

This patent relates generally to cleaning assemblies and apparatus and, more particularly, to railroad track cleaning assemblies and apparatus.

BACKGROUND

Signals are utilized in the railroad industry to indicate the presence of a train, for example. Over time, corrosion or other debris such as leaves may accumulate on railroad tracks that prevent these signals from properly functioning (e.g., circuits not being completed). Improperly functioning signals hinder the ability of trains to run normally.

DETAILED DESCRIPTION

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

The examples described herein relate to example vehicles or carts having opposing example railroad track cleaning assemblies. The railroad track cleaning assemblies include spring assemblies that enable rotating brushes of the railroad track cleaning assemblies to substantially maintain contact with and apply a substantially constant force to respective railroad tracks regardless of inconsistencies in the railroad tracks and/or brush wear. By maintaining contact with and applying a substantially constant force to the railroad tracks, the railroad tracks may be more thoroughly cleaned while preventing premature brush wear caused by the inability of the brushes to automatically longitudinally adjust during a cleaning process.

Figure 1:
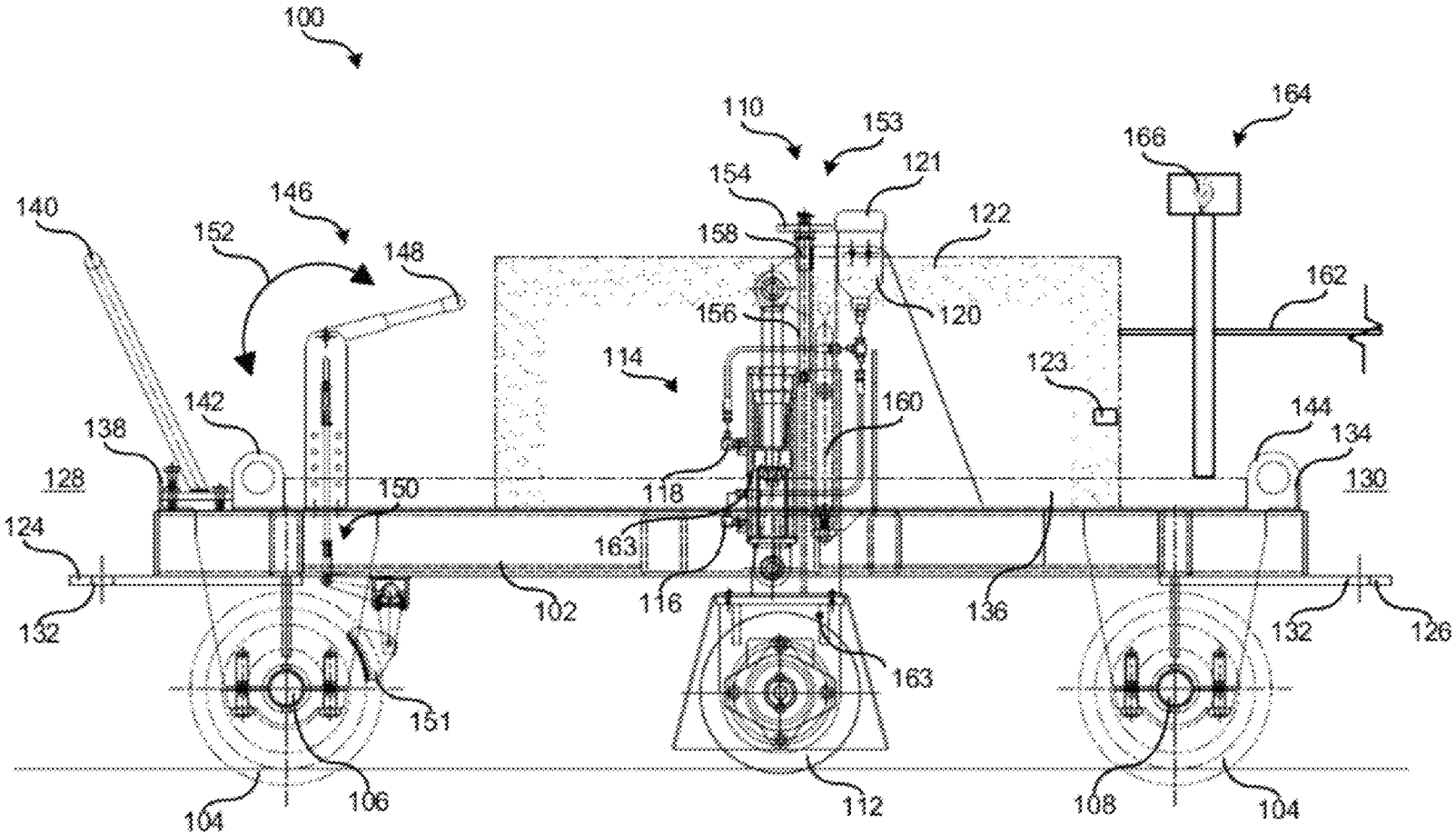
FIGS. 1-3 depict different views of an example cart for cleaning railroad tracks.
Figure 2:
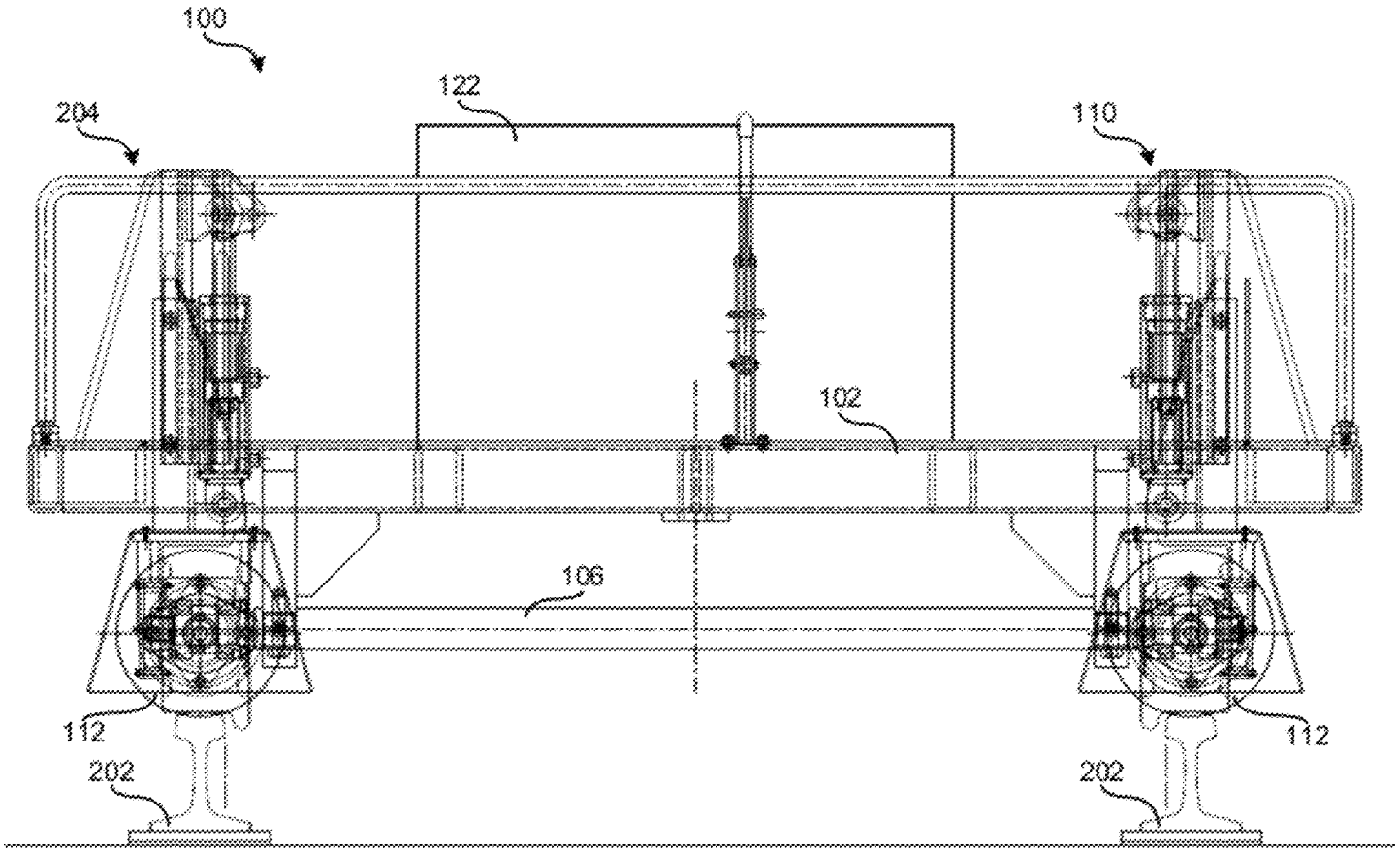
Figure 3:
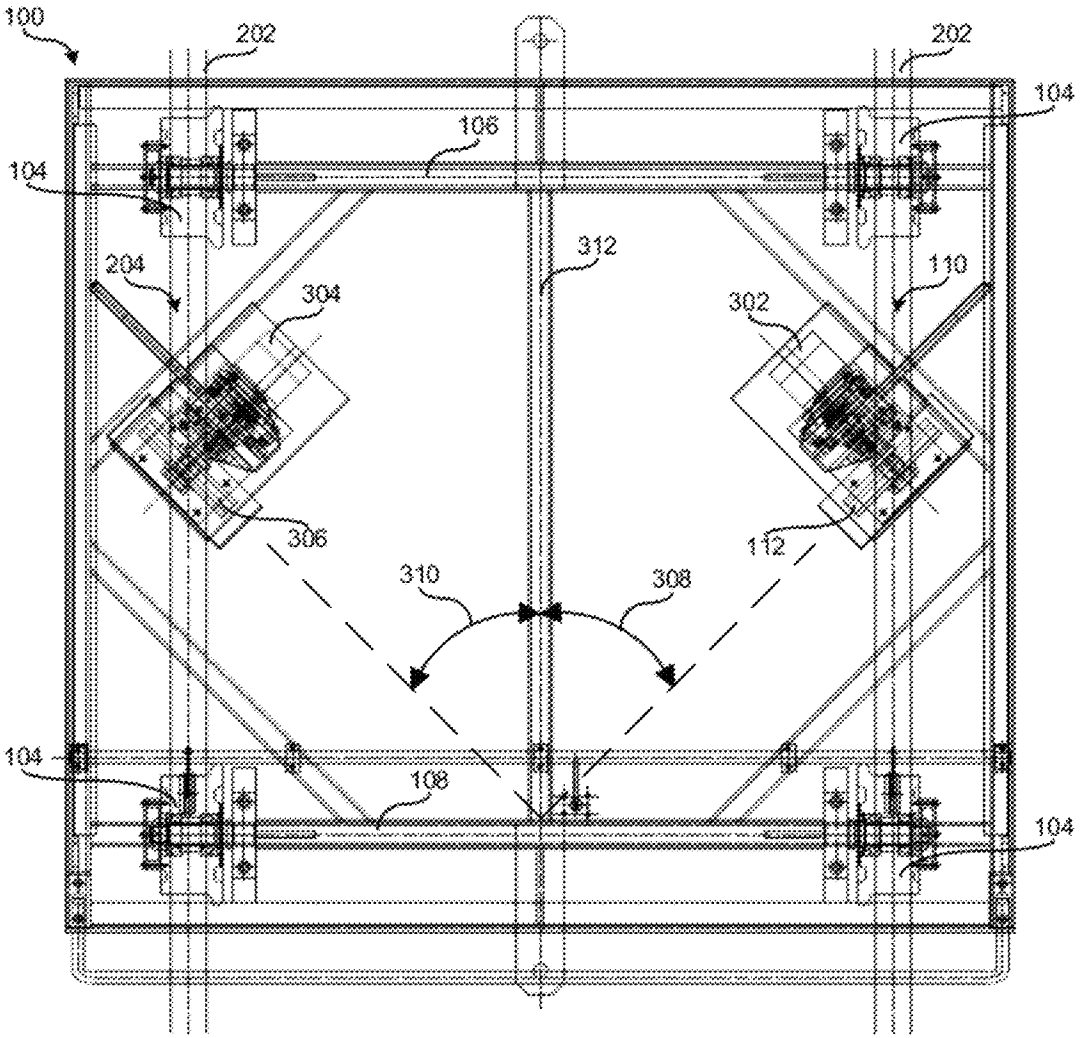

FIGS. 1-3 depict different views of an example cart, vehicle or apparatus 100 for cleaning railroad tracks. Referring to FIG. 1, the example cart 100 includes a frame (e.g., main frame) 102 and a plurality of wheels or track wheels 104 rotatably coupled to the frame 102 via axles 106 and 108. The axles 106 and 108 may be spaced approximately 55.50 inches apart; however, any other spacing (e.g., 40.0 inches, 45.0 inches, 50.0 inches, etc.) may be used instead.

The cart 100 includes a plurality of opposing railroad track cleaning assemblies (one of which is represented by reference number 110) having brushes (one or more of which is represented by reference number 112) that are configured to clean railroad tracks. The railroad track cleaning assemblies 110 include spring assemblies 114 that bias the brushes 112 into engagement with the respective railroad track. Additionally or alternatively, the spring assemblies 114 enable the brushes 112 to independently longitudinally adjust when the brushes 112 encounter height or vertical inconsistencies in the railroad tracks. By enabling the railroad track cleaning assemblies 110 to independently longitudinally adjust, the brushes 112 are able to substantially maintain continuous contact with the respective railroad track and/or are able to apply substantially constant forces to the respective railroad track. The substantially constant forces applied by the brushes 112 to the respective railroad tracks may be between about thirty to eighty pounds of pressure and/or force, for example.

The spring assemblies 114 include ports 116 and 118 that may be fluidly coupled to one another and/or a reservoir 120. The ports 116 and 118 enable the spring assemblies 114 to be maintained at a substantially consistent and/or substantially atmospheric pressure, for example. A lid 121 may sealingly engage the reservoir 120 to substantially prevent contaminants such as dust or dirt from entering the reservoir 120 and/or the spring assemblies 114.

The cart 100 may include a power unit 122 to provide power to motors (not shown) of the railroad track cleaning assemblies 110. The motors rotate the brushes 112 which in turn clean the railroad tracks. The power unit 122 may be a hydraulic power unit and the motors may be hydraulic motors; however, in other examples, the power unit 122 may be a generator and the motors may be electric motors, for example. The power unit 122 may include one or more couplings, adapters and/or fittings such as quick disconnects 123 to enable the motors and/or other equipment (e.g., hydraulic tools) to be fluidly coupled to and, thus, powered by the power unit 122, for example.

The cart 100 may include a plurality of hitches 124 and 126 that extend from respective sides 128 and 130 of the cart 100. The hitches 124 and/or 126 may define apertures 132 that correspond to and/or receive a hook or other device of a motor vehicle. An interaction between the hitches 124 and/or 126 and the hook or other device enables the cart 100 to be towed on railroad tracks during a cleaning process, for example.

The cart 100 may include one or more barriers (e.g., angle iron) 134-138 that at least partially surround a perimeter of the cart 100 to protect portions of the cart 100 from impact. The cart 100 may also include a handle assembly 140 and a plurality of lifting eyes 142 and 144. The handle assembly 140 enables a person to push, pull or otherwise manually move the cart 100. The lifting eyes 142 and 144 provide contact points to facilitate lifting of the cart 100 onto or from railroad tracks using machinery such as a crane or a boom lift, for example.

The cart 100 may include a brake assembly 146 including a handle 148, linkage 150 and one or more break shoes 151. Moving the handle 148 in a direction generally represented by arrows 152 changes the position of the respective break shoes 151 relative to the corresponding wheel 104 via the linkage 150 to enable or prevent movement of one or more of the wheels 104 of the cart 100. Specifically, by moving the handle 148 such that the respective break shoes 151 engage the corresponding wheel 104, movement of the cart 100 is substantially prevented. Alternatively, by moving the handle 148 such that the respective break shoes 151 disengage the corresponding wheel 104, movement of the cart 100 is enabled.

In operation, the cart 100 may be positioned on railroad tracks using the lifting eyes 142 and/or 144. Once positioned on the railroad tracks, the cart 100 may be coupled to a motor vehicle via the hitch 126 to enable the cart 100 to be towed.

When the cart 100 is being transported, stored or not cleaning railroad tracks, the brushes 112 of the railroad track cleaning assemblies 110 may be positioned or moved to be at a distance from (e.g., not in engagement with) the ground or the railroad tracks. Prior to initiating a cleaning process, a person may rotate adjusters 153 to longitudinally adjust the railroad track cleaning assemblies 110 relative to the frame 102 to enable the brushes 112 to engage the corresponding railroad track. The adjuster 153 includes a knob 154 and a threaded shaft or rod 156. The threaded shaft 156 extends through a portion or tube 158 of the frame 102 and threadingly engages and/or disengages a carriage (e.g., a moveable carriage, a spring loaded carriage) 160 of the railroad track cleaning assembly 110. Other adjuster(s) of the cart 100 may have similar structure.

The motors of the railroad track cleaning assemblies 110 may then be coupled (e.g., fluidly coupled) to the one or more fittings 123 of the power unit 122 using hose (e.g., hydraulic hose), for example. The power unit 122 may be turned on to provide power to the motors, which in turn rotate the brushes 112 between about 1400-1500 revolutions per minute (RPM), for example. In some examples, the cart 100 includes a lead(s) 162 to be communicatively coupled to the motor vehicle. By communicatively coupling the cart 100 and the motor vehicle, the power unit 122 and, thus, the motors may be turned on or off by a person within the motor vehicle, for example.

As the motor vehicle tows the cart 100 at between about 15-20 miles per hour, for example, the motors turn the respective brushes 112 contacting the railroad tracks. The interaction between the brushes 112 and the railroad tracks cleans the railroad tracks by substantially removing corrosion such as carbonization and/or other debris such as compacted leaves from the railroad tracks.

As the brushes 112 clean the respective railroad tracks, one or more sensors 163 may identify an amount of wear of the brushes 112. In some examples, the one or more sensors 163 may be positioned adjacent to the respective brushes 112. Additionally or alternatively, the one or more sensors 163 may be positioned to identify a position of the respective railroad track cleaning assembly 110 relative to the frame 102. The position of the respective railroad track cleaning assembly 110 relative to the frame 102 may be associated with an amount that the brush 112 is worn.

If the brushes 112 are identified as being worn a particular amount (e.g., approximately one half inch), a signal may be transmitted by the sensor 163 to an indicator 164. The indicator 164 may then indicate to a person in the motor vehicle towing the cart 100 that the brushes 112 are worn. In this example, a light 166 on the indicator 164 may light up when the brushes 112 are worn; however, the indicator 164 may indicate that the brushes 112 are worn in any other suitable way such as emitting a sound. While the indicator 164 is depicted on the cart 100, the indicator 164 may be positioned within the motor vehicle towing the cart 100, for example. In other examples, the cart 100 may not be provided with the indicator 164.

FIG. 2 depicts a different view of the example cart 100 positioned on railroad tracks 202. As shown in FIG. 2, the cart 100 includes the first railroad track cleaning assembly 110 and a second railroad track cleaning assembly 204. The first and second railroad track cleaning assemblies 110 and 204 may be substantially mirror images of one another and each may be configured to clean one of the railroad tracks 202.

FIG. 3 depicts another view of the example cart 100 on the railroad tracks 202. The railroad tracks 202 may be spaced 56.5 inches apart and, thus, the wheels are spaced (e.g., 56.5 inches) to enable the cart 100 to be moved on the railroad tracks 202.

The first railroad track cleaning assembly 110 may include a motor such as a hydraulic motor 302 to turn the one or more brushes 112 operatively coupled thereto as the brushes 112 engage one of the railroad tracks 202. Similarly, the second railroad track cleaning assembly 204 may include a motor such as a hydraulic motor 304 to turn one or more brushes 306 operatively coupled thereto as the brushes 306 engage another one of the railroad tracks 202. In operation, the orientation of the brushes 112 and 306 relative to the cart 100 is typically as depicted in FIG. 3. As such, the orientation of the brushes 112 and/or 306 in FIGS. 1 and 2 are merely examples.

To enable the cart 100 to ride smoothly on the railroad tracks 202, forces applied to the railroad tracks by the brushes 112 and 306 may be cancelled. To substantially cancel these forces applied to the railroad tracks 202 by the brushes 112 and 306, the brushes 112 and 306 are positioned at substantially opposing non-parallel angles 308 and 310 relative to a longitudinal axis 312 of the cart 100, for example. In this example, the brushes 112 of the first railroad track cleaning assembly 110 are positioned at approximately a positive forty five degree angle relative to the longitudinal axis 312 and the brushes 306 of the second railroad track cleaning assembly 204 are positioned at approximately a negative forty five degree angle relative to the longitudinal axis 312; however any other suitable angle may be used instead (e.g., +/−thirty degrees; +/−thirty five degrees; +/−forty degrees, etc.).

Figure 4:
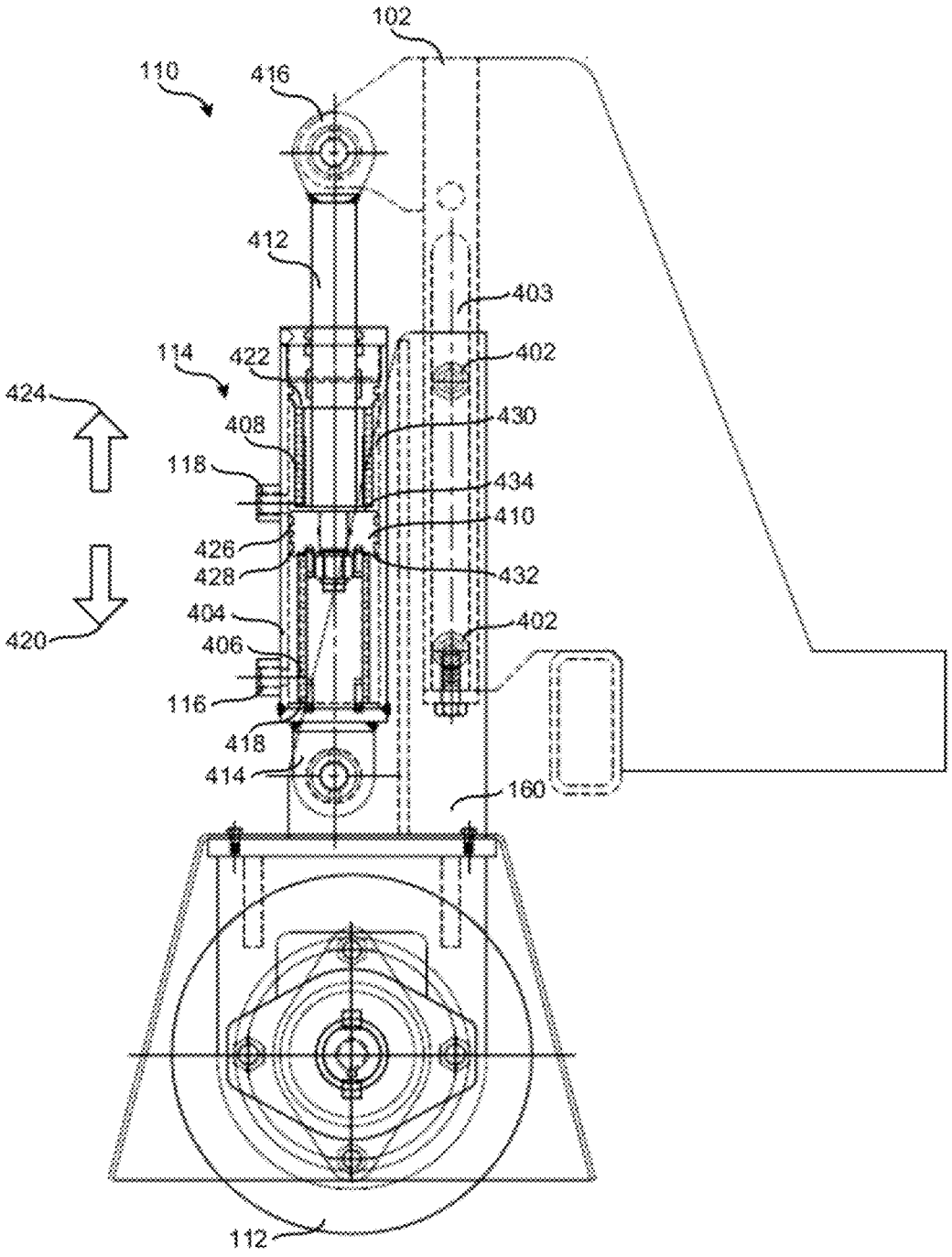
FIGS. 4-6 depict different views of an example railroad track cleaning assembly of the example cart of FIGS. 1-3.
Figure 5:
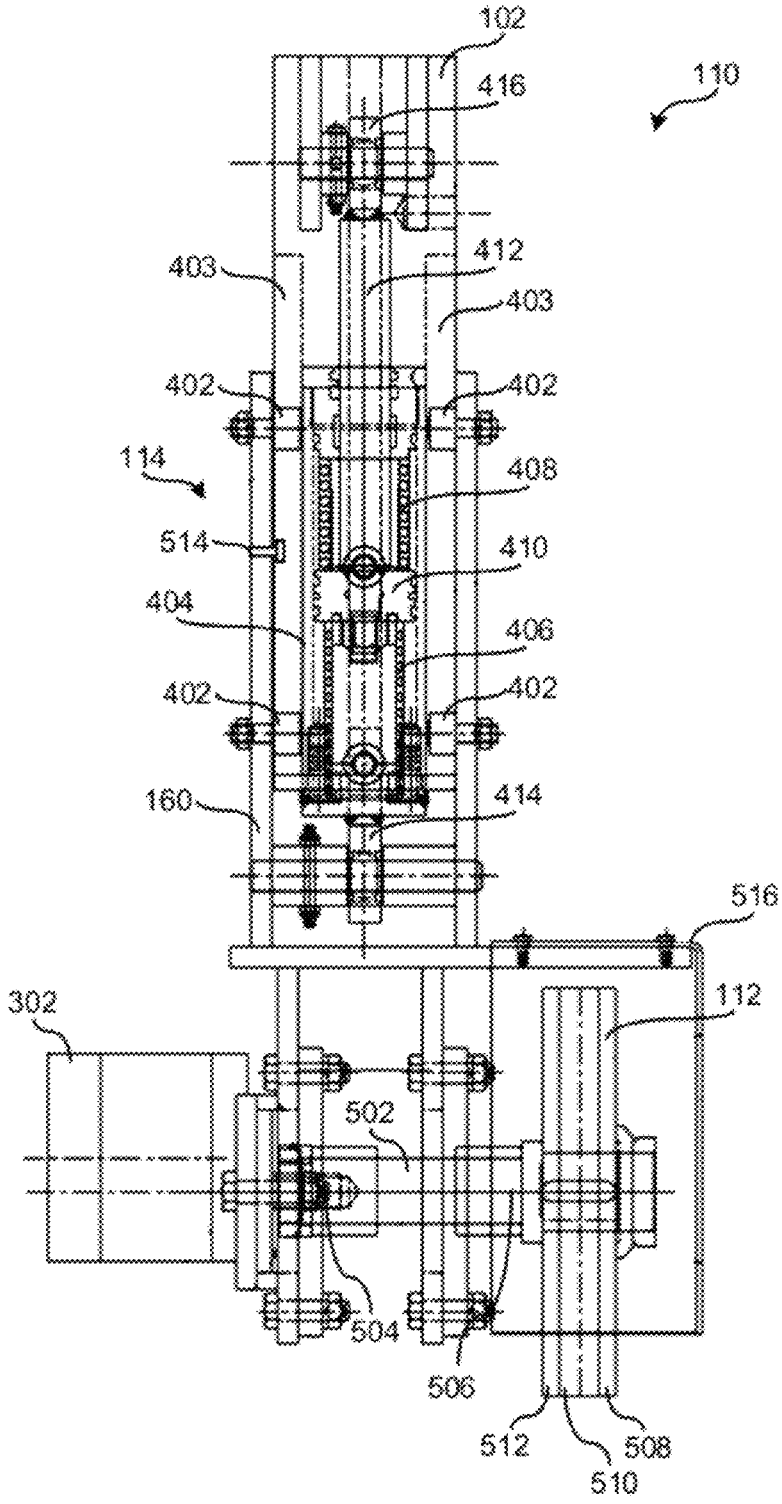
Figure 6:
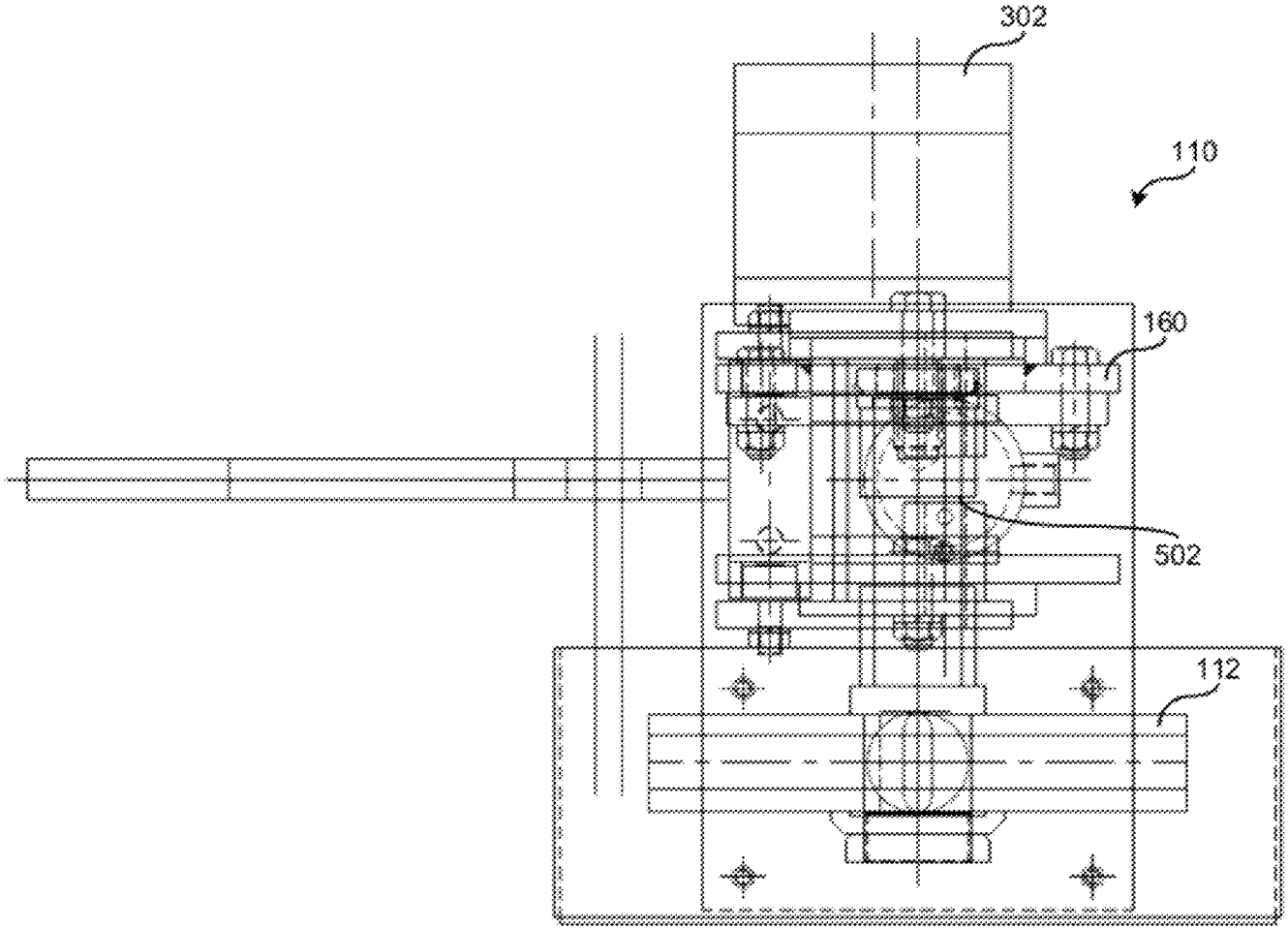

FIGS. 4-6 depict different views of a portion of the first railroad track cleaning assembly 110. Because the first railroad track cleaning assembly 110 and the second railroad track cleaning assembly 204 may be substantially mirror images of one another, the second railroad track cleaning assembly 204 will not be described in detail herein.

Turning to FIG. 4, the first railroad track cleaning assembly 110 includes the carriage 160 to which the brushes 112 are operatively rotatably coupled. Additionally, the first railroad track cleaning assembly 110 includes the spring assembly 114 that biases the brushes 112, via the carriage 160, into engagement with one of the railroad tracks. In this example, the carriage 160 is moveably coupled to the frame 102 via an interaction between track followers or rollers 402 of the carriage 160 and a track 403 defined by the frame 102.

The spring assembly 114 may include a spring housing or cylinder 404 into which a first spring 406, a second spring 408 and a piston or spring seat 410 having an extension or rod 412 are at least partially positioned. The spring housing 404 includes an end 414 coupled (e.g., rotatably or pivotably coupled) to the carriage 160 and the extension 412 has an end 416 that extends from the spring housing 404 and is coupled (e.g., rotatably or pivotably coupled) to the frame 102.

In this example, the piston 410 is positioned between the first and second springs 406 and 408; however, any other number of springs (e.g., 1, 2, 3, 4, etc.) positioned on either one or both sides of the piston 410 may be used instead. The first spring 406 exerts a first force on a portion 418 of the spring housing 404 in a direction generally represented by arrow 420 to urge the brushes 112, via the carriage 160, into engagement with one of the railroad tracks. The second spring 408 exerts a second force substantially opposite the first force on a portion 422 of the spring housing 404 in a direction generally represented by arrow 424 to urge the brushes 112, via the carriage 160, out of engagement with one of the railroad tracks and/or toward the frame 102. By providing the spring assembly 114 with the springs 406 and 408 on either side of the piston 410 and, thus, applying forces in opposing directions to the piston 410, the likelihood that, over time, the piston 410 becomes stuck or seized (e.g., substantially immovable) within the spring housing 404 may be substantially reduced.

The first and second springs 406 and 408 may have different lengths and/or different spring forces. For example, the first spring 406 may have an uncompressed length of approximately six-inches and a compressed length of approximately four-inches and the second spring 408 may have an uncompressed length of approximately four-inches and a compressed length of approximately three-inches. The first spring 406 may have a spring force of approximately 65 pounds and the second spring 408 may have a spring force of approximately 135 pounds and/or the spring forces of the springs 406 and 408 may be approximately a one-to-two ratio, for example.

In operation, if the railroad track corresponding to the first railroad track cleaning assembly 110 has a dip or low point, the spring assembly 114 (e.g., the first spring 406 of the spring assembly 114) may urge the carriage 160 and the brushes 112 downward to maintain contact with and/or apply a substantially constant force to the railroad track. Similarly, as the brushes 112 wear, the spring assembly 114 may urge the carriage 160 and the brushes 112 downward to maintain contact with and/or apply a substantially constant force to the railroad track. Alternatively, if the railroad track corresponding to the first railroad track cleaning assembly 110 has a ridge or high point, the spring assembly 114 (e.g., the second spring 408 of the spring assembly 114) may urge the carriage 160 and the brushes 112 upward enabling contact to be maintained with the railroad track while substantially preventing too much force (e.g., a relatively large force or inconsistent force) being applied by the brushes 112 to the respective railroad track. If too much force is applied to the railroad track by the brushes 112, the brushes 112 may prematurely wear and/or components (e.g., the motor 302) of the cart 100 may be damaged and/or overly strained, for example.

The piston 410 may define one or more grooves 426 that receive corresponding seals 428 that slidably and/or sealingly engage an interior surface 430 of the spring housing 404. Because the spring housing 404 may contain fluid (e.g., oil, hydraulic oil), the interaction between the seals 428 and the interior surface 430 substantially prevents the fluid from flowing between the piston 410 and the interior surface 430.

To enable pressure on either side of the piston 410 to be substantially the same and/or substantially at atmospheric pressure, the spring housing 404 includes the first and second ports 116 and 118 that may be fluidly coupled to one another and/or the reservoir 120 (FIG. 1), for example. In operation, as the carriage 160 moves relative to the frame 102, the spring housing 404 moves relative to the piston 410, thereby moving fluid (e.g., oil, hydraulic oil) through the respective ports 116 and 118. For example, if the brushes 112 encounter a ridge or high point in the railroad track that urges the brushes 112 and the carriage 160 toward the frame 102, fluid flows out of the spring housing 404 on a first side 432 of the piston 410 through the first port 116 and into the spring housing 404 on a second side 434 of the piston 410 through the second port 118. Alternatively, if the brushes 112 encounter a dip or low point in the railroad track that enables the brushes 112 and the carriage 160 to move away from the frame 102 to maintain engagement with the railroad track, fluid flows into the spring housing 404 on the first side 432 through the first port 116 and out of the spring housing 404 on the second side 434 of the piston 410 through the second port 118.

Turning to FIG. 5, to couple the motor 302 to the brushes 112, a shaft 502 extends through the carriage 160 and has a first end 504 coupled to the motor 302 and a second end 506 to which the brushes 112 are coupled. The shaft 502 may have any suitable diameter such as two inches; however, the shaft 502 may have a different diameter. The second end 506 may be spaced approximately 24.65 inches from the axle 106 (FIG. 1) and spaced approximately 30.85 inches from the axle 108 (FIG. 1); however, the shaft 502 may be differently positioned relative to the axles 106 and 108. In operation, the motor 302 rotates the shaft 502, which in turn rotates the brushes 112. In this example, the brushes 112 include a first brush (e.g., a wire wheel brush) 508, a second brush (e.g., a nylon wheel brush) 510 and a third brush (e.g., a wire wheel brush) 512. The first and third brushes 508 and 512 may be substantially similar and may be positioned on either side of the second brush 510. However, any of the brushes 508-512 may be similar or different and any other number (e.g., 1, 2, 3, 4, etc.) of brushes may be used instead.

The first railroad track cleaning assembly 110 may include a sensor 514 to sense and/or identify an amount of wear of the brushes 112 based on the position of the carriage 160 relative to the frame 102, for example. While the first railroad track cleaning assembly 110 includes the sensor 514 adjacent the frame 102, the sensor 514 may be positioned in any other suitable position to identify the amount of wear of the brushes 112 such as adjacent the brushes 112. However, in some examples, the first railroad track cleaning assembly 110 may not be provided with the sensor 514.

The first railroad track cleaning assembly 110 may include a cover (e.g., a wheel brush cover) 516 coupled to the carriage 160 to control the deflection of debris (e.g., leaves) during the cleaning process.

FIG. 6 depicts an alternative view of the first railroad track cleaning assembly 110.

Figure 7:
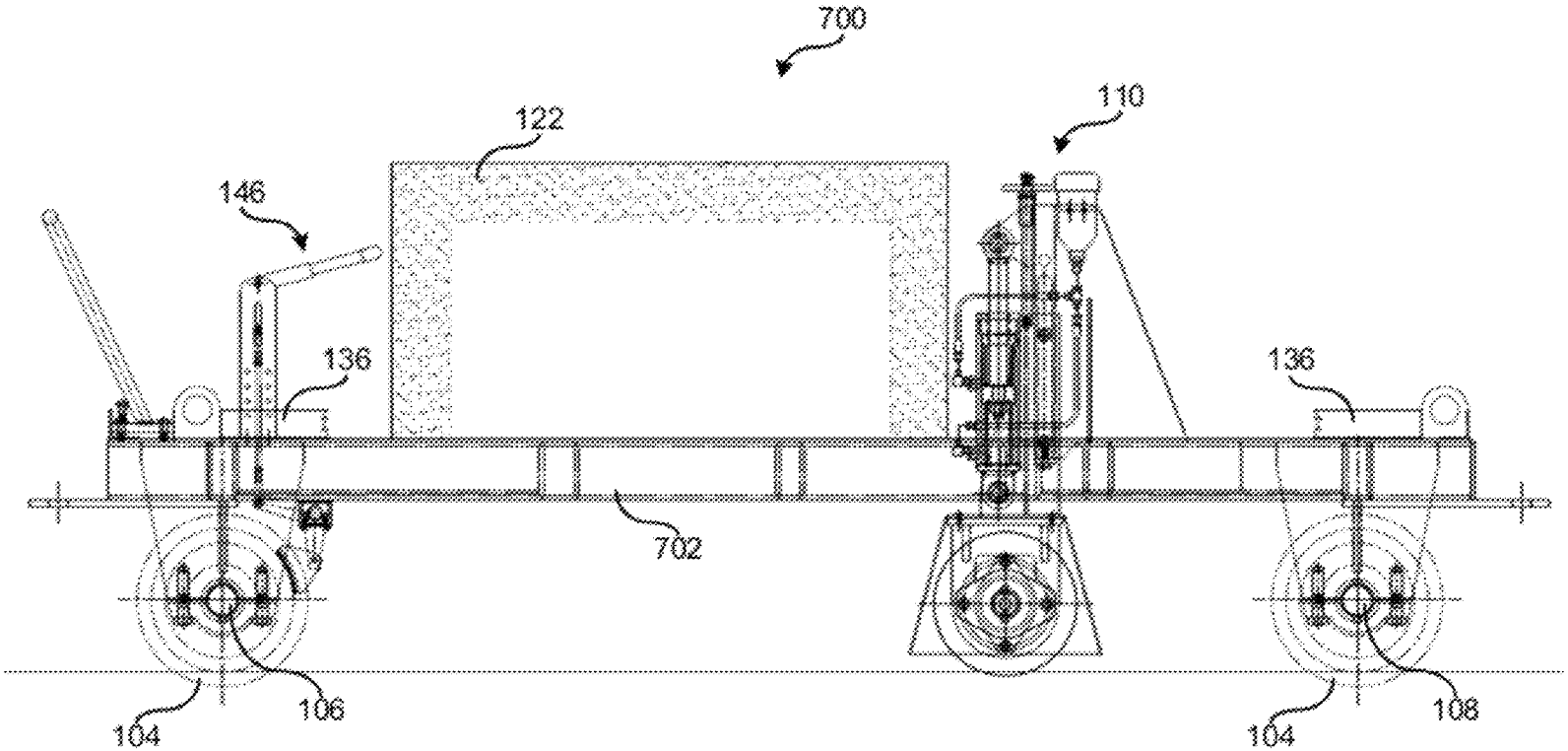
FIGS. 7-8 depict different views of another example cart for cleaning railroad tracks.
Figure 8:
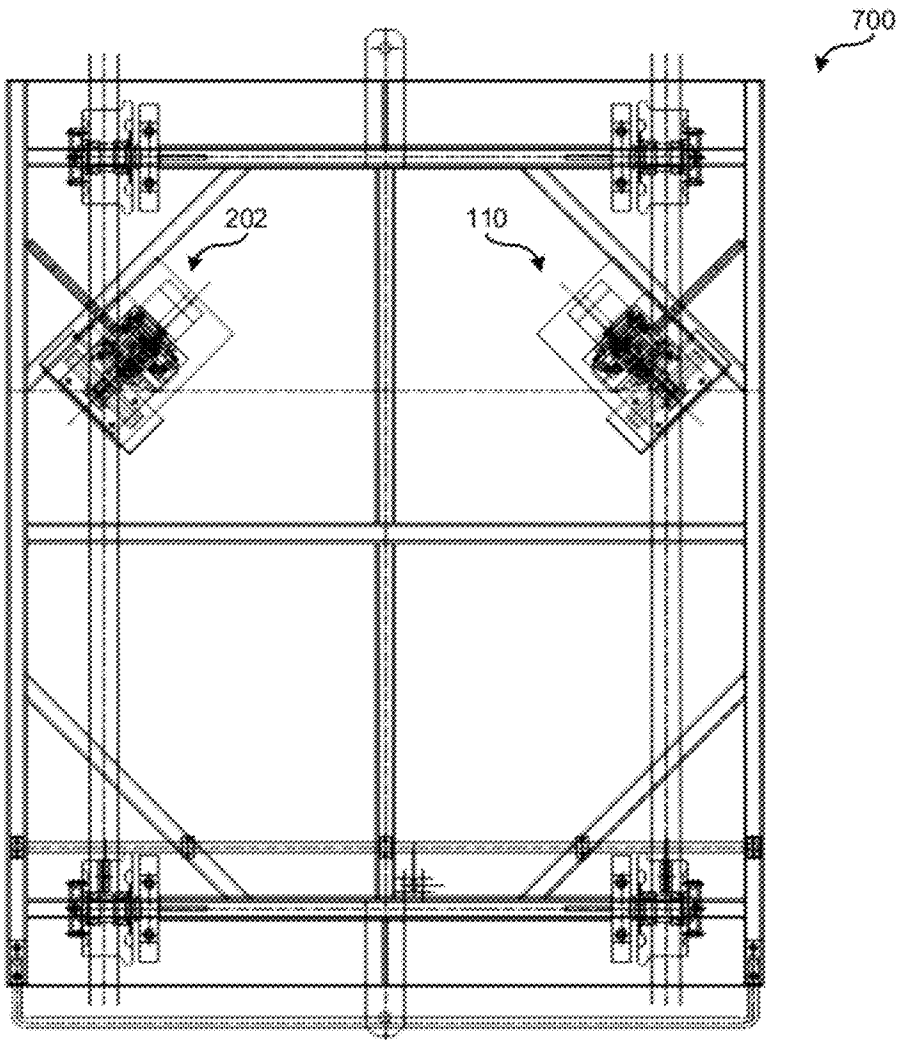

FIGS. 7 and 8 depict different views of an alternative example cart, vehicle or apparatus 700 for cleaning railroad tracks. The cart 700 is substantially similar to the cart 100 described above. However, in contrast, the cart 700 includes a frame 702 that is slightly longer than the frame 102 of the cart 100. For example, the cart 700 may have a length of approximately 96.0 inches and the spacing between the axles 106 and 108 may be approximately 79.5 inches while the cart 100 may have a length of approximately 72.0 inches and the spacing between the axles 106 and 108 may be approximately 55.5 inches. As such, the example cart 700 may be slightly heavier than the example cart 100. For example, the cart 700 may weigh approximately 2500 pounds while the cart 100 may weigh approximately 1700 pounds, for example.

Figure 9:
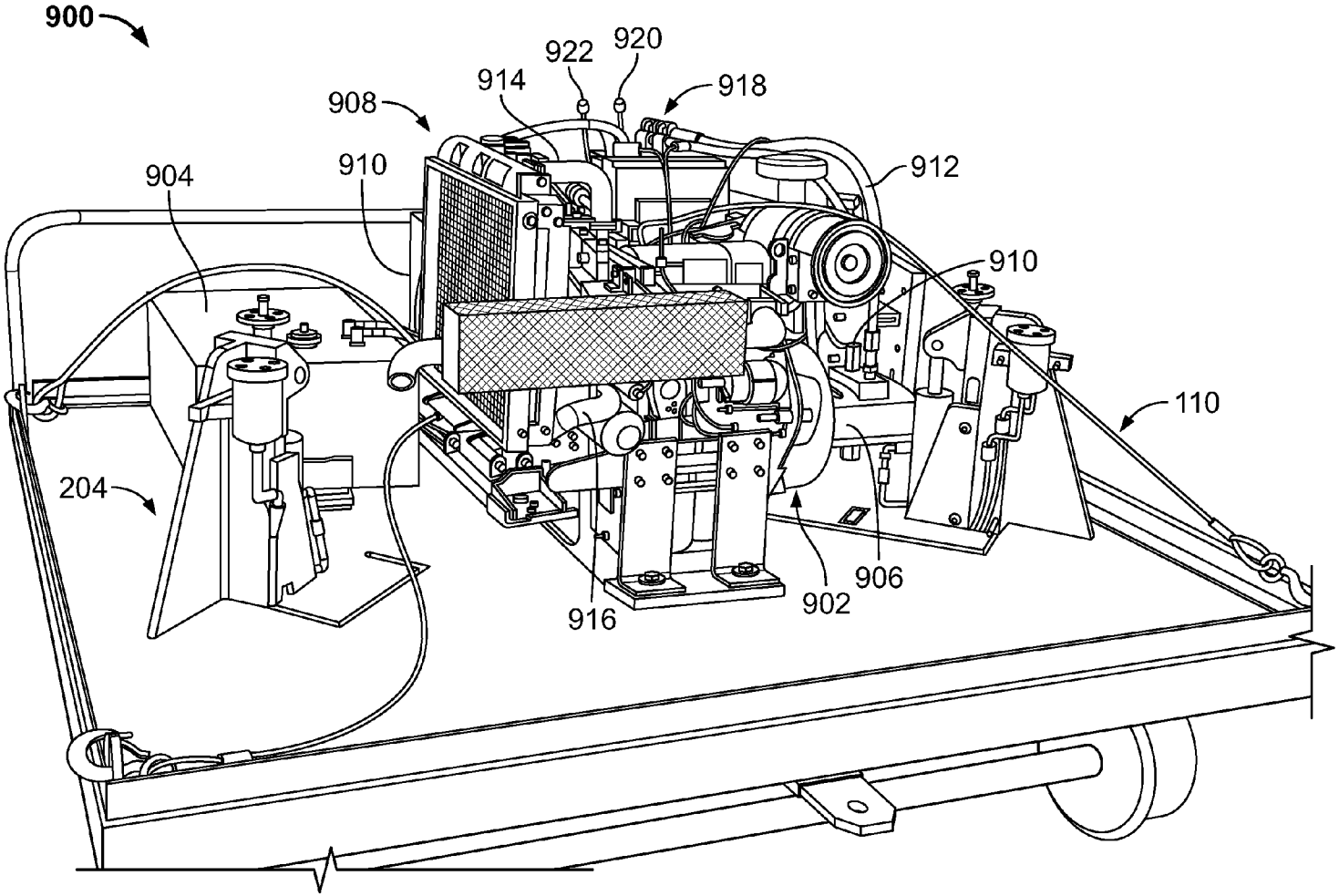
FIGS. 9-11 depict different views of another example cart for cleaning railroad tracks.
Figure 10:
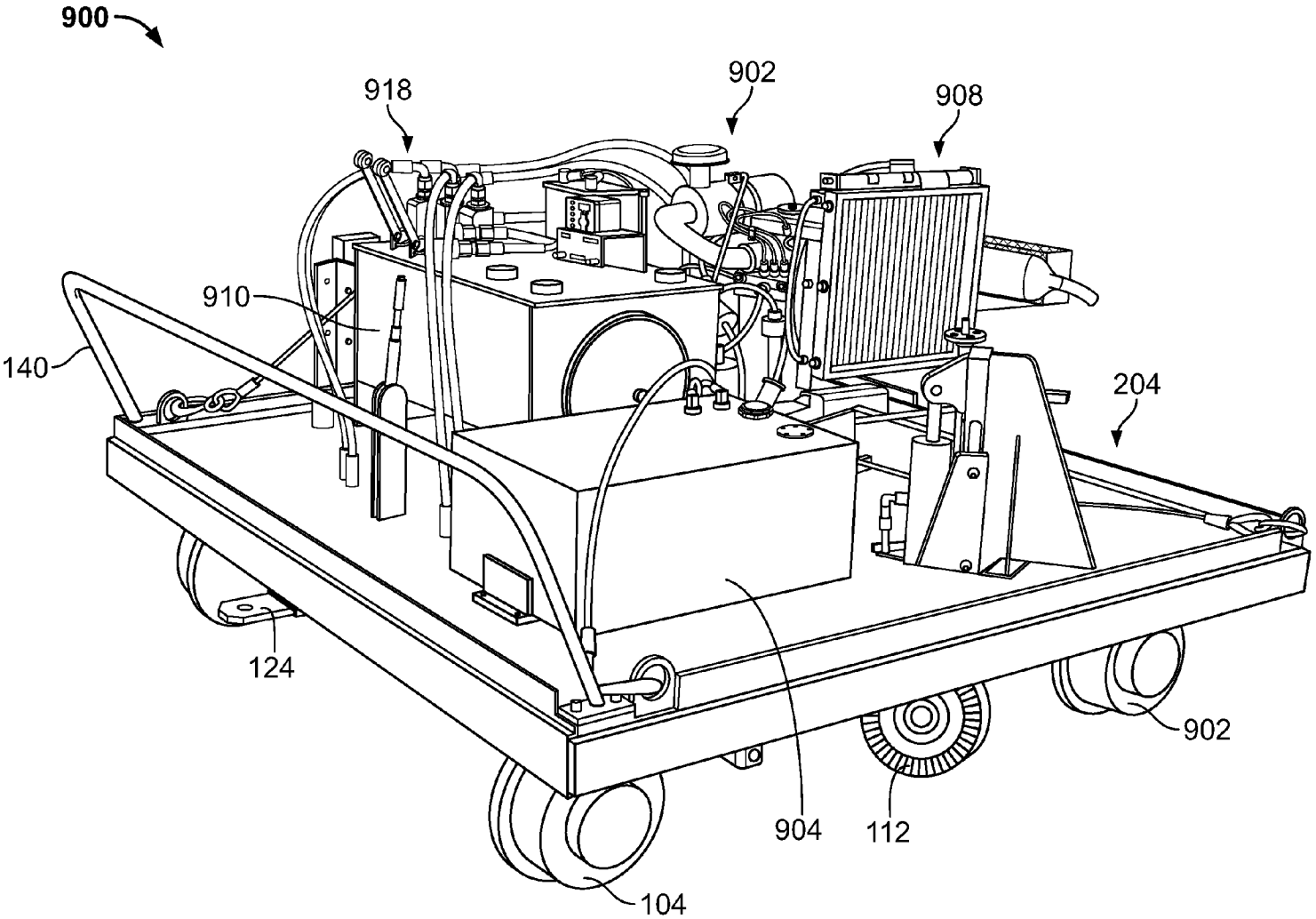
Figure 11:
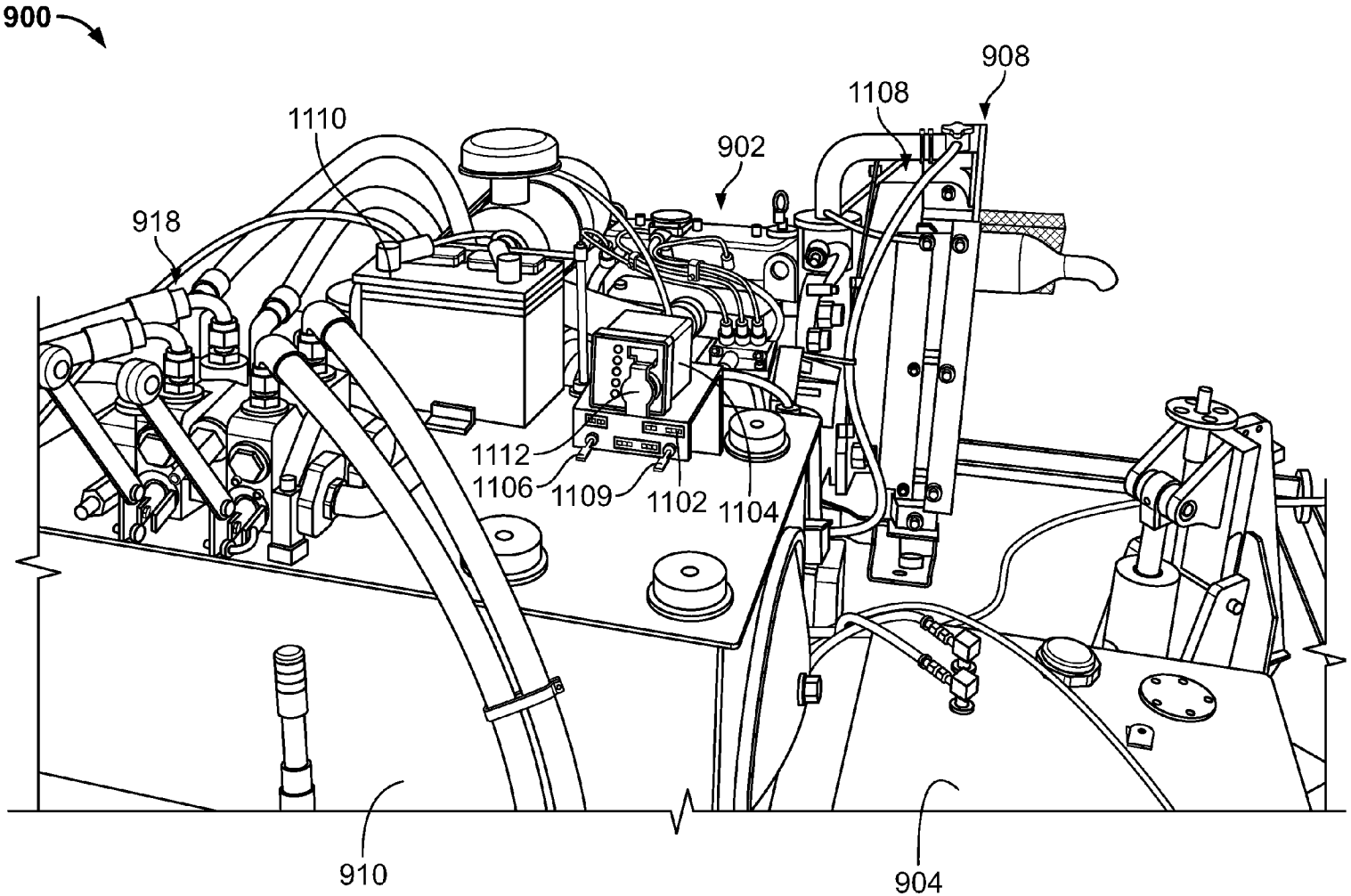

FIGS. 9-11 depict different views of an alternative cart, vehicle or apparatus 900 for cleaning railroad tracks. In contrast to the carts 100 and 700 described above that are provided with the power unit 122, the cart 900 includes a motor (e.g., a diesel motor) 902 and a fuel tank 904 fluidly coupled to the motor 902. The motor 902 may provide more power to rotate the brushes 112 of the railroad track cleaning assemblies 110 and/or 204 at a faster rate than the power unit 122 described above. For example, the motor 902 may turn the brushes 112 at approximately between about 2500 RPM and 2800 RPM. Rotating the brushes 112 at a faster rate, enables the cart 900 to be towed behind a vehicle while cleaning the railroad tracks at a faster rate.

In practice, the motor 902 drives a pump 906 that pumps fluid (e.g., hydraulic fluid) from a reservoir (e.g., a hydraulic fluid reservoir) 910 through one or more of a plurality of hoses 910-916 to the hydraulic motors that rotate the brushes 112 of the railroad track cleaning assemblies 110 and/or 204. In some examples, the pump 906 may also pump the fluid through a cooling system 908 to cool the fluid.

The cart 900 additionally includes a flow control apparatus (e.g., a plurality of valves) 918. The flow control apparatus 918 includes a first handle 920 and a second handle 922. By moving the first handle 920, one of the valves of the flow control apparatus 918 is actuated to enable fluid to flow to the hydraulic motor that rotates the brushes 112 of the first railroad track cleaning assembly 110. By moving the first handle 920 in the opposite direction, the corresponding valve is closed. By moving the second handle 922, another one of the valves of the flow control apparatus 918 is actuated to enable fluid to flow to the hydraulic motor that rotates the brushes 112 of the second railroad track cleaning assembly 204. By moving the second handle 922 in the opposite direction, the corresponding valve is closed.

Turning to FIG. 11, a detailed view of a controller 1102 and an indicator 1104 of the cart 900 are shown. In some examples, the controller 1102 includes a first switch 1106 that may be moved to turn a fan 1108 of the cooling system 908 on and/or off. In some examples, the controller 1102 includes a second switch 1109 that may be moved to change the revolutions per minute of the motor 902. The indicator 1104 may convey information to a person regarding the cart 900 via a plurality of lights, for example. Some of the information may include the temperature of the hydraulic fluid, the amount of hydraulic fluid in the reservoir 910, the charge of a battery 1110, etc. or any other information regarding the cart 900. In some examples, the indicator 1104 may include an adapter 1112 to enable a lead to be coupled thereto to convey information regarding the cart 900 to a vehicle towing the cart 900, for example.

The examples described herein include several advantages. For example, the example carts may be towed or pulled and, thus, perform a cleaning process at relatively faster rates than known approaches. Additionally or alternatively, the example carts may clean railroad tracks more thoroughly by maintaining substantially continuous contact with the respective railroad tracks regardless of inconsistencies. Additionally or alternatively, the examples described herein may automatically adjust as the brushes wear maintaining contact with the respective railroad tracks and decreasing reliance on manual operator adjustments.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A railroad track cleaning assembly, comprising:

a movable carriage movably coupled to a frame to which a plurality of wheels are operably coupled to enable the frame to move on railroad tracks;

a shaft rotatably coupled to the movable carriage to receive one or more brushes that are to be rotated and engage one of the railroad tracks; and an actuator coupled to the movable carriage and to the frame to bias, via the movable carriage, the one or more brushes into engagement with the one of the railroad tracks, wherein biasing the one or more brushes into engagement with the one of the railroad tracks enables a substantially constant force to be applied to the one of the railroad tracks via the one or more brushes, wherein the substantially constant force is between about thirty pounds and eighty pounds of pressure.

2. A railroad track cleaning assembly, comprising:

a movable carriage movably coupled to a frame to which a plurality of wheels are operably coupled to enable the frame to move on railroad tracks;

a shaft rotatably coupled to the movable carriage to receive one or more brushes that are to be rotated and engage one of the railroad tracks; and an actuator coupled to the movable carriage and to the frame to bias, via the movable carriage, the one or more brushes into engagement with the one of the railroad tracks, wherein the movable carriage further comprises one or more track followers positioned in a track of the frame to movably couple the movable carriage to the frame.

3. The railroad track cleaning assembly of claim 2, further comprising a hydraulic motor coupled to the movable carriage and to the shaft to rotate the one or more brushes via the shaft.

4. The railroad track cleaning assembly of claim 2, further comprising an adjuster coupled to the frame and the movable carriage to enable a position of the movable carriage to be longitudinally adjusted relative to the frame.

5. The railroad track cleaning assembly of claim 2, further comprising a sensor to identify an amount of wear of the one or more brushes.

6. The railroad track cleaning assembly of claim 5, further comprising an indicator to indicate the amount of wear of the one or more brushes.

7. A railroad track cleaning assembly, comprising:

a movable carriage movably coupled to a frame to which a plurality of wheels are operably coupled to enable the frame to move on railroad tracks;

a shaft rotatably coupled to the movable carriage to receive one or more brushes that are to be rotated and engage one of the railroad tracks; and an actuator coupled to the movable carriage and to the frame to bias, via the movable carriage, the one or more brushes into engagement with the one of the railroad tracks, wherein the actuator comprises:

a spring housing having an end coupled to the movable carriage;

first and second springs positioned in the spring housing; and a piston from which an extension extends and is coupled to the frame, wherein the piston is positioned between the first and second springs.

8. The railroad track cleaning assembly of claim 7, wherein the first spring has a first spring force and the second spring has a second spring force different than the first spring force.

9. The railroad track cleaning assembly of claim 7, wherein the spring housing defines a plurality of ports to enable either side of the piston to be maintained at substantially atmospheric pressure.

10. The railroad track cleaning assembly of claim 9, wherein the plurality of ports are fluidly coupled to a reservoir.

11. A railroad track cleaning assembly, comprising:

a movable carriage movably coupled to a frame to which a plurality of wheels are operably coupled to enable the frame to move on railroad tracks;

a shaft rotatably coupled to the movable carriage to receive one or more brushes that are to be rotated and engage one of the railroad tracks;

an actuator coupled to the movable carriage and to the frame to bias, via the movable carriage, the one or more brushes into engagement with the one of the railroad tracks; and an adjuster coupled to the frame and the movable carriage to enable a position of the movable carriage to be longitudinally adjusted relative to the frame, wherein the adjuster includes a knob coupled to a threaded shaft that engages or disengages the movable carriage.

12. A vehicle for cleaning railroad tracks, comprising:

a frame to which a plurality of wheels are operably coupled to enable the vehicle to move on railroad tracks;

first and second opposing carriages movably coupled to the frame, wherein the first and second carriages further comprise one or more track followers positioned in a track of the frame to movably couple the first and second movable carriages to the frame;

first and second shafts rotatably coupled to the respective first and second opposing carriages to receive one or more brushes that are to be rotated to clean the railroad tracks; and first and second actuators coupled to the respective first and second opposing carriages and to the frame to bias, via the respective carriages, the one or more brushes into engagement with the corresponding railroad track.

13. The vehicle of claim 12, wherein the first and second shafts are positioned at opposing non-parallel angles relative to a longitudinal axis of the vehicle.

14. The vehicle of claim 13, wherein the opposing non-parallel angles are a substantially positive forty five degree angle and a substantially negative forty five degree angle.

15. The vehicle of claim 12, further comprising first and second hydraulic motors coupled to the respective first and second opposing carriages and to the respective first and second shafts to rotate the one or more brushes via the respective shaft.

16. The vehicle of claim 15, further comprising a hydraulic power unit coupled to the frame and to be fluidly coupled to the first and second hydraulic motors.

17. The vehicle of claim 16, wherein the hydraulic power unit includes one or more couplings to provide power to other equipment.

18. The vehicle of claim 15, further comprising a motor coupled to the frame to power a pump to be fluidly coupled to the first and second hydraulic motors.

* * * * *